United States Patent [19]

Serkov et al.

[11] 4,159,299

[45] Jun. 26, 1979

[54] METHOD FOR THE PRODUCTION OF RAYON

[76] Inventors: Arkady T. Serkov, prospekt Mira, 131, kv. 20; Gennady A. Budnitsky, ulitsa Onezhskaya, 55, kv. 45, both of Moscow; Nina P. Shishkina, ulitsa Scherbakova, 4, kv. 41, Mytischi Moskovskoi oblasti; Viktor A. Kalitin, ulitsa Dispansera, 38, korpus 1, kv. 75, Mytischi Moskovskoi oblasti; Boris M. Sokolovsky, ulitsa Pervomaiskaya, 27, kv. 71, Mytischi Moskovskoi oblasti; Leonid A. Bylinsky, Veshnyaki-Vladygino, ulitsa Moldagulovoi, 8, korpus 2, kv. 3, Moscow; Evsei M. Mogilevsky, Kutuzovsky prospekt, 17, kv. 9, Moscow; Igor P. Baksheev, proezd Shokalskogo, 53, kv. 140, Moscow; Lev G. Marakhovsky, ulitsa Pravdy, 37, kv. 9, Kalinin; Viktor V. Markov, ulitsa Sklizkova, 81a, kv. 39, Kalinin; Nadezhda F. Rumyantseva, ulitsa Vagzhanova, 2, kv. 99, Kalinin; Alexandr S. Daniljuk, ulitsa Vagzhanova, 2, kv. 102, Kalinin; Ljudmila N. Panova, Novomytischinsky proezd, 47, korpus 2, kv. 197, Mytischi Moskovskoi oblasti; Oleg S. Kozyrev, ulitsa Grazhdanskaya, 8, kv. 23, Pskov; Lev G. Kaller, ulitsa Krasilovskaya, 5/2, kv. 10; Viktor L. Silyanchik, ulitsa Yaroslava Gasheka, 4, kv. 16, both of Kiev; Georgy G. Finger, ulitsa Matveevskaya, 4, korpus 2, kv. 27, Moscow; Ivan G. Shimko, ulitsa Kominterna, 13/4, kv. 24, Moscow; Valery V. Konoplev, ulitsa M. Jushunskaya, 8, korpus 2, kv. 68, Moscow; Albina K. Khakimova, ulitsa Pervomaiskaya, 19a, kv. 8, Mytischi Moskovskoi oblasti, all of U.S.S.R.

[21] Appl. No.: 674,132

[22] Filed: Apr. 6, 1976

[51] Int. Cl.[2] ..... D01D 5/14

[52] U.S. Cl. ..... 264/180; 264/181; 264/197

[58] Field of Search ..... 264/180, 181, 197; 425/68

[56] References Cited

U.S. PATENT DOCUMENTS

| | | | |
|---|---|---|---|
| 1,414,076 | 4/1922 | Elsaesser | 264/199 |
| 2,154,893 | 4/1939 | Eisenhut et al. | 264/196 |
| 2,898,629 | 8/1959 | DeGee | 264/181 |
| 2,908,937 | 10/1959 | Hesselink | 264/180 |
| 3,032,385 | 5/1962 | Osugi et al. | 264/180 |
| 3,071,806 | 1/1963 | Rosenthal | 264/181 |
| 3,084,384 | 4/1963 | Denyes et al. | 264/181 |
| 3,131,429 | 5/1964 | Okamura | 264/181 |
| 3,240,852 | 3/1966 | Denyes et al. | 264/181 |
| 3,452,129 | 6/1969 | Isobe et al. | 264/180 |
| 3,689,620 | 9/1972 | Miyazaki et al. | 264/199 |

FOREIGN PATENT DOCUMENTS

| | | | |
|---|---|---|---|
| 869676 | 3/1953 | Fed. Rep. of Germany | 264/180 |
| 45-2766 | 1/1970 | Japan | 264/181 |
| 45-31691 | 10/1970 | Japan | 264/181 |

*Primary Examiner*—Jay H. Woo

*Attorney, Agent, or Firm*—Fleit & Jacobson

[57] ABSTRACT

A method and apparatus for the production of rayon and for the continuous processing of filaments is disclosed. Filament threads are formed in a spinning column in which they are completely regenerated and stretched by the action of a constant temperature coagulating solution. The total length of the spinning column considerably exceeds the length of the column portion in which the rayon yarns are formed. The coagulating solution, after the formation of the rayon yarns, flows at a speed less than that of the threads at the column outlet eliminating an entire zone to the treatment of spun threads with strong high-temperature solution, heretofore necessary for complete regeneration of the threads.

6 Claims, 6 Drawing Figures

METHOD FOR THE PRODUCTION OF RAYON

The present invention relates to textile machinery for continuous processing of filaments and, more particularly, it relates to methods and apparatus for the production of rayon.

At present, there is known a method of the production of filaments (cf. U.S. Pat. No. 2,987,764, C1.425-68).

In accordance with the method disclosed in U.S. Pat. No. 2,987,764, a viscose solution is continuously extruded through a spinnerette into a spinning column into which a coagulating solution is continuously fed. As a result of the interaction of these solutions, filaments threads are formed which are sequentially, while still moving, completely regenerated, stretched, finished, dried and wound into package form.

Each of the above processes is performed by special individual units of an apparatus, the latter comprising a device for feeding the viscose solution, a spinning column, a device for continuously passing the coagulating solution through the spinning column, a device for washing and finishing the threads, a drying cabinet, and a winding device.

Devices used for washing and finishing the threads include coiled pipes, guide rolls, eductors, troughs, and liquid treatment rolls. In such an apparatus, the spun threads, while in gel state, after having emerged from the spinning column, are subjected to multiple bends and friction while in contact with filament guiding parts and the walls of the spinning columns. This not only makes the servicing of the apparatus more difficult, but also results in inferior quality filament threads, since the repeated friction causes abruption thereof. Besides, to ensure normal operation of the apparatus, a liquid flowing at a high speed which increases the number of faults in the filament threads must be used in the eductors.

In addition, the threading pattern employed requires great amounts of water for removal of the spin bath component from the filament threads which makes regeneration more difficult.

Furthermore, the spinning column is tapered, its cross-section gradually decreasing towards the outlet. Such a configuration promotes the stretching process carried out in the spinning column, but the obtained stretching is ineffectual since it is performed within the zone of emergency of the viscose solution streams from the spinnerette, i.e. within the region of the minimum viscosity of the filamentary material.

Also known is a spinning column with an abruptly changing diameter of its sections. As a result, a number of alternate zones are formed in the column: the zones in which the coagulating solution moves more rapidly than the filament threads and the zones in which the filament threads move more rapidly than the coagulating solution. Such an arrangement of the zones affects the hydrodynamic conditions of thread formation, viz. the high speed of flow of liquid relative to the speed of the filament threads in the narrow portions of the column causes abruption of the filaments (especially in the first zone, wherein the filamentary material is still in a gel state) which pass into the next zone in which the liquid flows more slowly than the filamentary material accumulating there, adhering to the column walls and travelling filamentary material. As a result, the number of defects in the filament thread greatly increases.

It is an object of the present invention to provide a method for the production of rayon threads which will allow simpler processing of the spun threads, to produce filament threads of a superior quality with high uniformity of properties, and to simplify the apparatus construction.

This and other objects are attained by the present inventive method for the production of filament threads. In this method, a viscose solution, forced through a spinnerette, and a coagulating solution are continuously fed into a spinning column in which the filament threads are formed. These filament threads, while still in motion, are sequentially completely regenerated, stretched, washed, finished, dried and wound into packages. In accordance with the present invention, the complete regeneration and stretching of the filament threads are carried out at a constant temperature by said coagulating solution in the spinning column. The total length of the spinning column considerably exceeds the length of the portion in which the filament threads are formed. The coagulating solution thereafter flows at a speed less than the speed of the threads at the column outlet whereby the threads are completely regenerated and succeedingly placed under tension and stretched due to the friction created by the threads and the coagulating solution moving at different rates of speed.

It is expedient to maintain the coagulating solution at a temperature not less than 30° C.

In the proposed method, the processes of spinning, complete regeneration, and stretching of the filament threads are combined and performed in the spinning column by the coagulating solution, having a constant strength and temperature. This makes it possible to exclude an entire zone for the treatment of spun threads with a strong solution, formerly required for regeneration of the filament threads and having a temperature as high as 98° C., thereby decidedly improving apparatus maintenance conditions. The movement of the filament threads, first at a higher and then at a lower speed on the one hand, considerably accelerate the diffusion of the coagulating solution components into the interior of the thread by breaking away the surface boundary layer thereof and, on the other hand, allows the complete regeneration and stretching of the filament threads by the very same solution.

In the present, the flow speed of the coagulating solution in the zone of complete regeneration and stretching is 1.3 to 3 times less than the flow speed in the spinning zone. It is therefore possible to stretch the threads by 15-30% as soon as the filamentary material attains the "effective" viscosity sufficient to ensure the required tenacity.

In addition, the amount of stretching may be varied, depending upon the height of the regenerated portion of the thread, without any additional mechanisms employed to decrease the flow rate of the coagulating solution in the upper portion of the column, an aid in draining the solution to the recirculation system.

It is preferable to sharply change the coagulating solution flow rate in the spinning column at a distance from the spinnerette equal to at least 0.3 of the spinning column length. This allows the stretching of the threads to be performed just where the effective viscosity attained. This should be distinguished from the situation where the solution flow rate is changed gradually and the friction applied is distributed over a great portion of the thread, the viscosity of the thread decreasing with the decreasing mobility of the macromolecular chains. Furthermore, in the practice of the present invention, the polymer completely settles out of the viscose solution, which is necessary for more efficient orientation stretching of the spun thread. The remaining two thirds or more of the column length serve to completely decompose the residual xanthate in the stretched thread.

It is desirable to place the threads, once rid of the coagulating solution, under additional tension in the course of washing, so that the thread increases in length by not less than 6% per meter of its initial length. This step is required to finally fix the predetermined orientation of the macromolecules in the thread to obtain a thread tenacity 10–15% higher than that of thread produced without additional tension applied thereto before washing.

An apparatus for the practice of the present invention includes a device, installed in the flow direction for forcing a viscose solution through a spinnerette and into a spinning column into which a coagulating solution is continuously fed, devices for washing and finishing of the threads, a drying device and a winding device. The spinning column is formed with the cross-section increasing in the direction of the thread advance and is composed of two portions sharply differing in their cross-section. The distance between the line of transition separating the portions and the spinnerette is equal to at least 0.3 of the length of the spinning column, the total column length considerably exceeding the length of the thread formation portion thereby allowing the regeneration and stretching of the formed threads to be carried out therein.

The preferred length of the column is at least 400 times greater than its smallest diameter.

This spinning column construction allows development of a spinning section small spaces between the work places and further allows for a reduction in the number of attending personnel. Moreover, since the coagulating solution is contained in the spinning column and emerges only together with the thread, a reduction of power consumption is thereby made possible.

In accordance with the invention, a device for washing the threads is installed in close proximity to a flaved end of the spinning column. This washing device comprises a roll, partially submerged into a solution containing bath and outfitted with a drive for roll rotation at a speed less than the speed of the threads, which threads, while being washed, contact the roll surface and are thus placed under an additional tension. It is therefore possible to employ a roll of large diameter and, consequently, to rotate it at a slower speed, and yet still achieve a high linear speed, thus improving the servicing conditions of the unit.

It has been found to be advantageous to adjust the roll linear speed to 5–95% of the speed of the threads to establish optimum processing conditions, thus obtaining the required physical and mechanical properties of the threads along with the improved servicing conditions for the apparatus.

It is preferable that the larger diameter of the spinning column be 1.1–1.7 times greater than the smaller diameter thereof which makes the manufacturing of the columns less expensive.

The smaller diameter spinning column portion comprises two telescopic-jointed parts, the lower parts of which is provided at the ends with detents, adapted to hold that part, when raised, to the upper part and, when lowered, to the body of the device, for the feeding of viscose solution. Consequently, very long spinning columns (more than 2 meters) may be used, while the threading conditions remain unchanged.

In the present invention the spinning column and the device for feeding the viscose solution are arranged on one side of the apparatus, the device for washing the threads, in the upper part thereof, and the device for chemical treatment and drying, as well as the winding device, are arranged on the other side. This arrangement simplifies the apparatus construction and, in addition, permits the segregation of all strong high-temperature solutions from the remainder of the apparatus making the machine easy to service and safe to operate.

This inventive apparatus for the production of yarn is simple and rugged in construction and easy to service. The apparatus operates at a high rate of productivity is small in size and contains a limited number of zones responsible for the liberation of deleterious gases. The apparatus further allows the production of the rayon yarns at high speeds (200 rpm and more), the thickness and tenacity of said yarns being variable within a wide range. This apparatus requires only small amounts of finishing liquids, which are usable in a subsequent effective regeneration, and further requires only a minimum number of movable parts to convey the threads simplifying the drives and reducing the number of attending personnel required. Other man-made yarns (e.g., cord, twine, ribbon straw, heat-resistant and high-strength synthetic yarns) may be produced by this apparatus as well.

Given below is a detailed description of the present invention with reference to the accompanying drawings, wherein.

Figure 2:
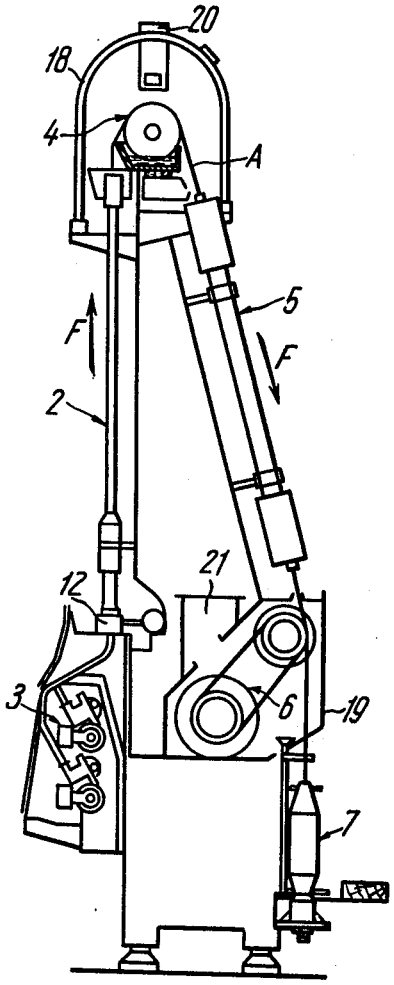
FIG. 2 is a schematic representation of a machine for the producton of rayon yarns, side view.
Figure 5:
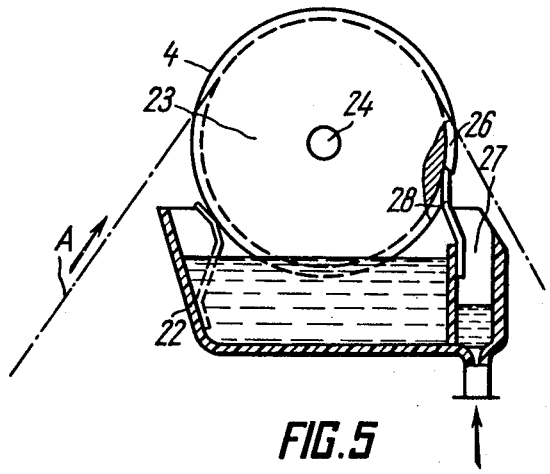
Figure 4:
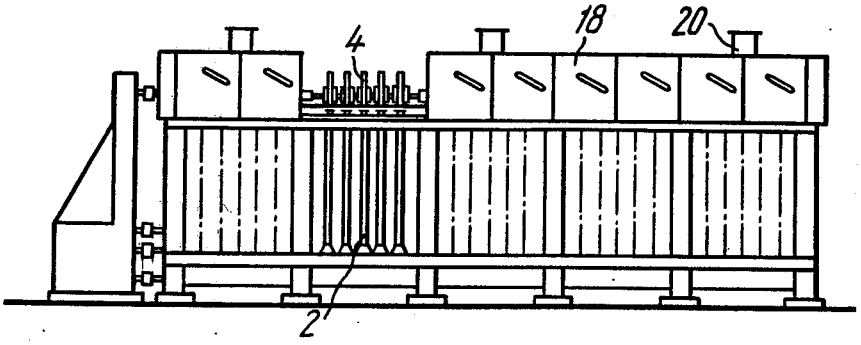
Figure 6:
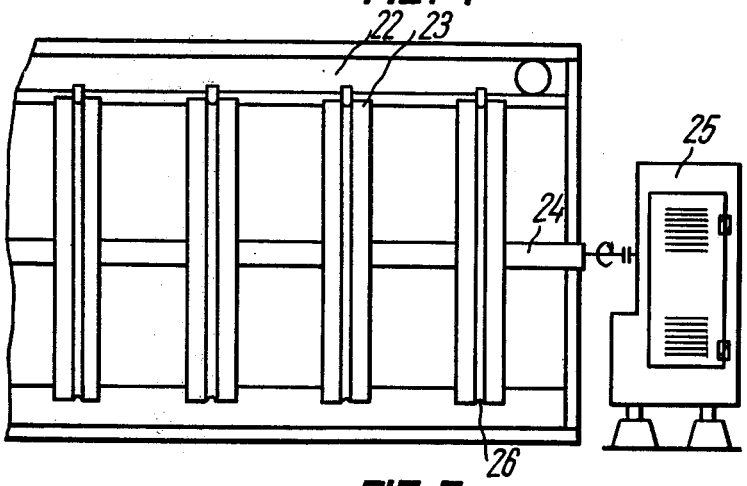

FIG. 3*a, b* is another embodiment of the spinning column;

FIG. 4 same as in FIG. 2, front view;

FIG. 5 is a schematic representation of a device for washing the threads, partly sectional view;

FIG. 6 shows schematically an arrangement of rolls in the device of FIG. 5.

In accordance with the present invention, filament threads A (FIG. 1) are produced as follows. A viscose solution, extruded through a spinnerette 1 in a direction shown by arrow B, and a coagulating solution, admitted in a direction shown by arrow C, are fed into a spinning column 2 wherein the filament threads A are formed, completely regenerated, and stretched. The column is divided into two portions, D and E. The threads A are formed in portion D and are regenerated and stretched in the portion E. Said threads are completely regenerated and stretched when acted upon by the coagulating solution which has a constant (uniform) temperature of 30°–65° C. over the entire length of the column. The entire path covered by the coagulating solution (i.e. the total length of the column equal to 2–5 m) considerably exceeds the length of the portion D wherein the threads are formed. Once the threads have been formed, the coagulating solution flows at a speed less than that of the threads at an output of the column 2 as a result of which the threads are completely regenerated placed under tension and stretched due to friction created by the coagulating solution and the threads moving at different speeds. The speed of the coagulating solution in the portion E, wherein the complete regeneration and stretching occurs is 1.3–3 times less than the speed of the coagulating solution in the portion within which the threads are formed, the speed changing abruptly. This abrupt change of the speed of the coagulating solution occurs at a distance from the spinnerette equal to at least 0.3 of the length of the spinning column 2. The threads, now devoid of the coagulating solution are placed under an additional tension, while being washed. At that time, the amount of tension applied is adjusted so the increase in thread length is at least 6% per meter of its initial length. Threads A, having been washed, are finished, dried and wound according to prior art methods.

In the use of this novel method for the production of the threads A, the degree of decomposition of the cellulose xanthate in the threads emerging from the spinning column 2 is at least 90%, the draw ratio being 1.1–2.0.

The present method can be adopted to an apparatus for the production of rayon yarns as shown in FIG. 2, which apparatus, like much of the apparatus now commonly in use, comprises a device 3 installed in the thread advancement direction for forcing the viscose solution through a spinnerette 1, the spinning column 2 to which the coagulating solution is continuously fed, a device 4 for washing the threads, a device 5 for finishing the threads, a drying device 6 and a winding device 7.

In an apparatus constructed in accordance with the present invention, the spinning column 2, installed in the direction of advance of threads 4 shown in FIG. 2 by an arrow F, is made with an increasing cross-section and is composed of two portions D and E (FIG. 1) which exhibit a sharp difference in cross-section, the distance between a line M, indicating the transition between one portion and the other, and the spinnerette 1 being equal to at least 0.3 of the length of the spinning column 2. The total length of the column 2 is at least 400 times greater than its smallest diameter, i.e. if the smallest diameter is 5–12 mm, the length of the column 2 is 2–5 m, which considerably exceeds the length of the column portion D in which the threads are formed. This arrangement further permits the subsequent complete regeneration and stretching of the spun threads to be performed in said column.

Figure 1:
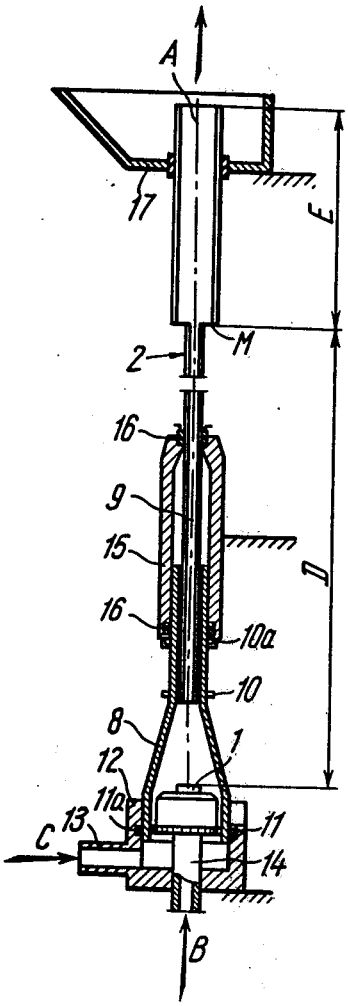
FIG. 1 is a spinning column, cross-sectional view.
Figure 3:
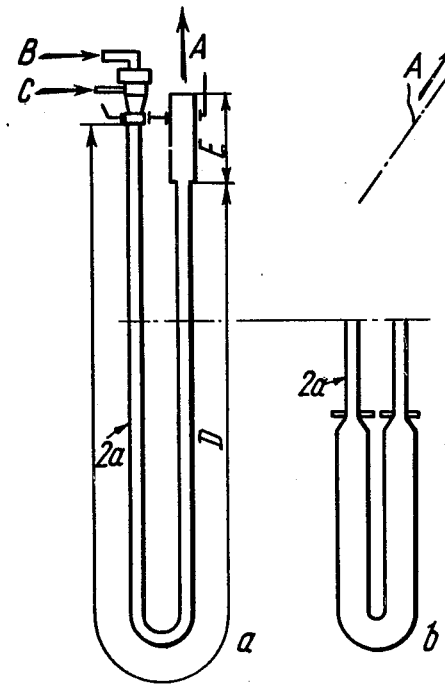

The spinning columns 2 are installed in the apparatus vertically or almost vertically. However, the shape of the column 2 is not restricted to a construction as illustrated in FIG. 1. The column 2 may have any shape suitable for effecting the proposed method. For example, it may be U-shaped (as shown in FIG. 3) and have a bent portion diameter equal to the diameter of the portion D as is shown in FIG. 3*a* or the bent portion may be of a greater diameter as is shown in FIG. 3*b* allowing the threads to travel through the centre of the bent portion at different rates of thread formation.

The diameter of the portion E( FIG. 1) of the column 2 is at least 1.1 times greater than that of the portion D.

To gain access to the spinnerette 1, the portion D of the spinning column 2 is made up of two telescopic-jointed parts 8 and 9. The lower part 9 of the column 2 is outfitted at the ends with detents 10 and 11 adapted to hold the part, when raised, to the upper part 9 and, when lowered, to a body 12 of the device 3 for the feeding of viscose solution.

The detents 10 and 11 are made as two projections provided on the outside of the part 8 and engaging recesses 10*a* and 11*a*, respectively.

The recesses 11*a* are made in the body 12 in which pipes 13 and 14 are provided for the passage of the coagulating solution and the viscose solution, respectively.

The packing of gaps between the upper 9 and lower 8 parts of the column 2 is attained by use of a cup 15 with recesses 10*a* and glands 16, each of said glands comprising a well-known V-shaped ring made of rubber, fluoroplastic or another elastic material.

The lower part 8 of the column 2 is flared at the lower end and enters the body 12 thereby surrounding the spinnerette 1 from above.

The outlet end of the column 2 is secured to a drip pan 17 into which the coagulating solution is drained from the column 2.

Inasmuch as the spinning column 2 of the apparatus is, as was stated above, very long, all of said columns, together with the viscose feeding devices 3, are arranged on one side of the apparatus, as is shown in FIGS. 2 and 4. The device 4 for washing the threads is disposed at the upper part of the apparatus and serves as a means for transferring the threads from one side, of the apparatus to the other side where the device 5 (FIG. 2) for chemical treatment of the threads, the drying device 6 and the winding device 7 are located.

This arrangement permits the use of various guarding means such as splash plates 18 and 19 which isolate the strong solution containing zones and systems 20 and 21 for removal of deleterious gases or vapours.

The device 4 for washing the threads is installed in a close proximity to the outlet end of the spinning column 2 and includes a water bath 22 into which, partially submerged, are rolls 23. The rolls 23 are mounted on a common shaft 24 geared into a known drive 25 (FIG. 6) for rotation of the rolls at a rate of speed less than that of the threads, the linear speed of the roll being equal to 5–95% of the speed of the threads. On the surface of the roll 23 there is a trough 26 whose depth corresponds to the amount of liquid required for washing the threads. Provided in the bath 22 (FIG. 5) is a section 27 adapted to collect and drain off the waste solution. A scraper 28 is installed in section 27 to remove the waste solution from the surface of the roll 23.

Well known steaming chambers in which threads undergo treatment with steam, soft water and avivage treatment may be used as the device 5 (FIG. 2) for finishing the threads.

The noxious gases liberated during the formation, complete regeneration, washing and final treatment of the threads are regenerated during which up to 60% of the carbon disulfide delivered for xanthation is recovered for recycling.

Given below are two examples of the production and treatment of the filamentary material in accordance with the present method.

EXAMPLE 1

The viscose solution containing 8.2% of alpha-cellulose, 6.5% of caustic soda with $\gamma=35$ is continuously forced through the spinnerette 1 into the coagulating solution flowing through the spinning column having a length of 4.5 m.

The spinnerette has 40 holes, each 0.08 mm in diameter. The coagulating solution is a mixture of sulfuric acid (160 g/lit), sodium sulfate (280 g/lit), zinc and sulfate (15 g/lit). The temperature of the spin bath is 65° C. The threads move at 180 m/min. The speed of flow of the coagulating solution in the portion D adapted to form the threads is 60 m/min; the speed of flow of the coagulating solution in the portion E is 90 m/min. The linear speed of the roll is 160 m/min.

The thread stretching is equal to 20%; the degree of decomposition of cellulose xanthate is 92%. The threads obtained after finishing and drying exhibit a 17.5-km breaking tenacity and an 18% breaking length.

The threads are free from piles and are of uniform dyeability.

EXAMPLE 2

The viscose solution contains 6.5% of alpha-cellulose, 4.0% of caustic soda with $\gamma=55$. The coagulating solution is a mixture of sulfuric acid (30 g/lit), sodium sulfate (70 g/lit), and zinc sulfate (15 g/lit). The viscose solution, continuously forced through the spinnerette having 40 holes, each 0.05 mm in diameter, flows along the spinning column, 3.5 m long. The speed of flow of the coagulating solution within the spinning zone is 170 m/min; the speed of the threads is 180 m/min; and the speed of the coagulating solution at the spinning column outlet is 120 m/min. The linear speed of the roll is 170 m/min, and the temperature of the coagulating solution is 40° C.

Stretching of the threads is equal to 18%, and the degree of decomposition of cellulose xanthate is 90%.

The threads obtainable after finishing and drying exhibit a 28-km breaking tenacity, a 10% breaking length, are free from piles and are of good dyeability.

What is claimed is:

1. A method for the production of rayon yarn in which a viscose solution is extruded through a spinnerette into a spinning column consisting of a first portion and a second portion, comprising the steps of:

(a) providing a spinning column position at a predetermined distance from said spinnerette, the total length of said spinning column considerably exceeding the length of said first portion, said second portion having a greater cross-sectional area than said first portion, said spinning column further having an abrupt transition between said portions located at a distance from said spinnerette equal to at least 0.3 times the total length of said spinning column;

(b) continuously feeding said extruded viscose solution and a coagulating solution having a constant temperature of 30° to 65° C. and constant strength into said first portion of said spinning column, thereby forming continuous filament threads;

(c) drawing said filament threads through said second portion of said spinning column wherein said coagulating solution is flowing at a speed less than that of said filament threads, thereby completely regenerating and stretching said threads;

(d) washing said filament threads under tension so that they increase at least 6% in length, finishing, drying and winding said filament threads.

2. A method as claimed in claim 1, wherein the speed of flow of the coagulating solution within a thread regeneration and stretching zone is 1.3 to 3 times lower than the speed of flow of the coagulating solution within a spinning zone.

3. The method of claim 1 wherein the spinning column is provided with a large conical portion at the end near the spinerette.

4. The method of claim 1 wherein the speed of the coagulating solution in the first zone is less than the speed of the filament formed therein.

5. The method of claim 1 wherein the diameter of the first portion of the spinning column provided is about 1.1 to 1.7 times greater than the diameter of the second portion of the spinning column.

6. The method of claim 1 wherein the spinning column provided comprises a pair of telescopic-jointed parts, said pair consisting of a lower part and an upper part, said lower part provided at its ends with detents adapted to hold said lower part, when raised, to said upper part and, when lowered, to a body for feeding the viscose solution.

* * * * *